United States Patent [19]

Bruhm

[11] Patent Number: 5,018,333

[45] Date of Patent: May 28, 1991

[54] ELASTOMERIC WEATHER SEAL FLASHING AND METHOD OF MANUFACTURE

[76] Inventor: Ronald Bruhm, 707 Arrow Rd., Weston, Ontario, Canada, M9M 2L4

[21] Appl. No.: 564,759

[22] Filed: Aug. 9, 1990

[51] Int. Cl.[5] ..... E04B 7/18

[52] U.S. Cl. ..... 52/741; 52/60; 52/200; 52/748

[58] Field of Search ..... 52/58, 60, 200, 219, 52/748, 741; 156/196, 211

[56] References Cited

U.S. PATENT DOCUMENTS

| | | | |
|---|---|---|---|
| 3,749,908 | 7/1973 | Esser | 52/200 |
| 3,838,544 | 10/1974 | Hindall | 52/60 |
| 4,635,409 | 1/1987 | Vandemore | 52/60 |
| 4,799,986 | 1/1989 | Janni | 52/58 |
| 4,848,051 | 7/1989 | Weisner | 52/200 |

FOREIGN PATENT DOCUMENTS

| | | | |
|---|---|---|---|
| 2142733 | 7/1978 | Fed. Rep. of Germany | 52/200 |
| 3603303 | 8/1987 | Fed. Rep. of Germany | 52/219 |

*Primary Examiner*—John E. Murtagh
*Attorney, Agent, or Firm*—K. Maxwell Hill

[57] ABSTRACT

A weatherseal flashing is made from sheet vulcanized rubber and surrounds a skylight frame situate on a roof curb. The weatherseal consists of a plurality of sealedly lapping panels each embodying a relatively wide apron and an upstanding flange extending along one elongated edge of the rectangular-shaped panel. The ends of each panel flange have overlapping sealedly connected wings on their ends to provide collectively, a continuous fastener for surrounding the inner side or leg of the skylight assembly to make a co-planar seal in engagement with the combined projecting curb and the skylight frame, and the roof surface.

1 Claim, 3 Drawing Sheets

FIG. 5
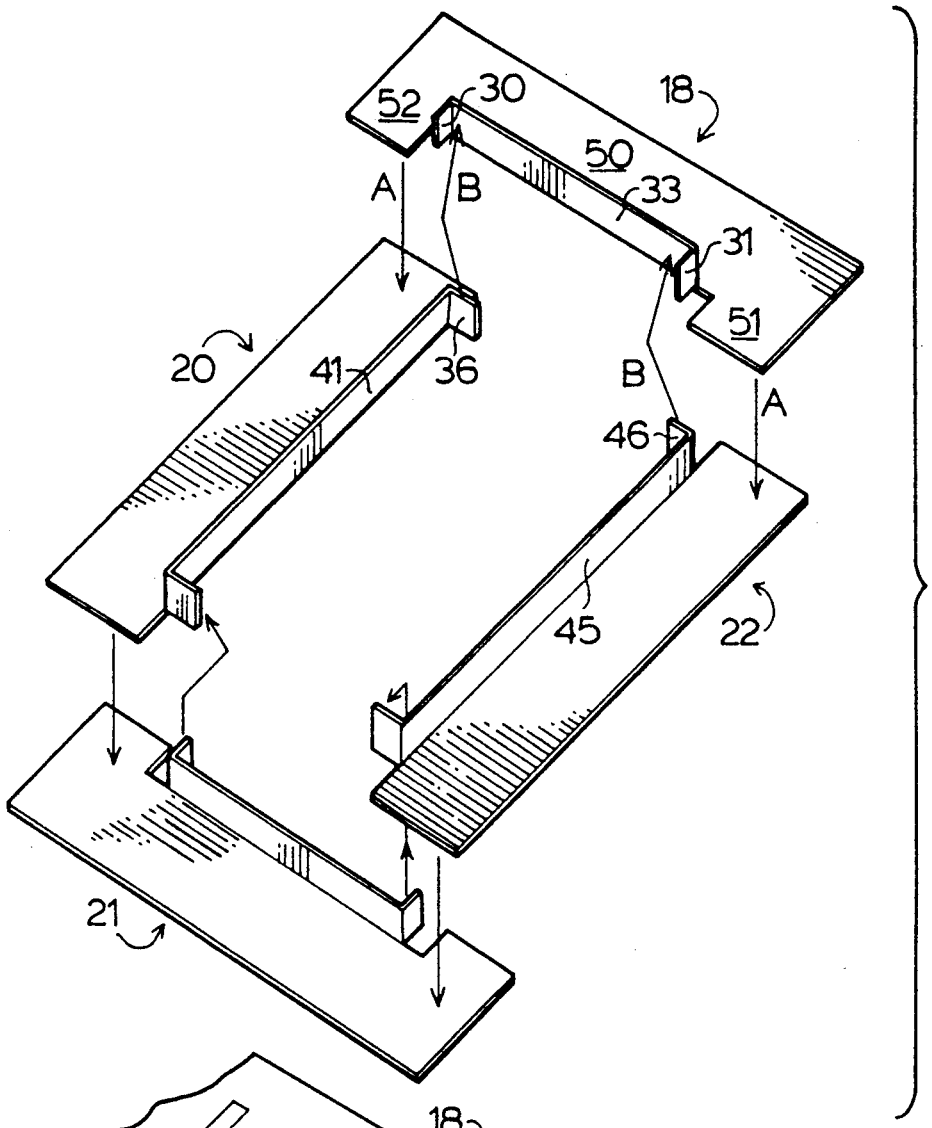
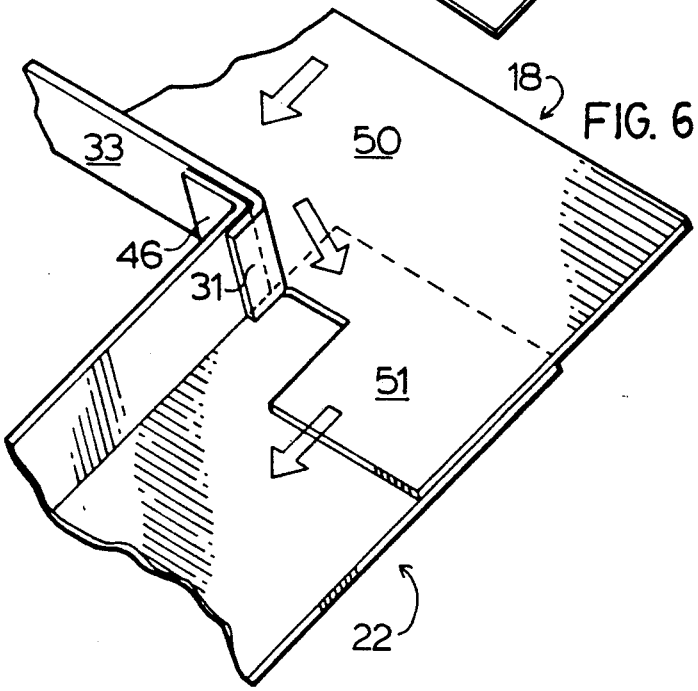
FIG. 6

ELASTOMERIC WEATHER SEAL FLASHING AND METHOD OF MANUFACTURE

FIELD OF INVENTION

The present invention relates to skylight flashing assemblies and in particular to an elastomeric weather seal for fitment to and surrounding the flashing skirt enveloping an upstanding curb of a roof. The seal is made from a sheet of elastomer such as rubber, and is cut into a plurality of sealedly lapping panels each embodying a wide apron and an upstanding flange. The flanges have overlapping sealed connected wings on their ends to provide collectively a continuous fastener to surround the inner edge of a curb frame or of the metallic or plastic flashing assembly.

PRIOR ART AND DISADVANTAGES THEREOF

It is known for skylight manufacturers to design the frames, curbs and caulkings with the primary objective of minimizing air infiltration into the skylight or eliminating the entrance of air around the base frame but litter consideration has been given to the retaining frame itself. Reference is made to U.S. Pat. Nos. 4,455,799 Jentoft and Coutoure, and 4,570,394 to the same inventors, where the manufacturers rely on either caulking or a gasket with unwelded corners or an extruded lip to minimize water infiltration. When water infiltrate around the retaining frame of the known type of flashings and between the retaining frame and the glazing material, it will usually remain there and evaporate over the glass causing steam and condensation. When caulking has been used it is known to deteriorate over time and will then hold moisture continuously thereby adding to the rot and moisture problem it was used to overcome.

OBJECTS OF THE INVENTION

The present invention provides the use of a rigid plastic retaining frame to surround the curb built up on the roof, in combination with a flexible lip incorporated in the frame to reduce water infiltration to nil and to retain, over time, a water proof seal that does not deteriorate with weathering. The frame is of rigid polyvinylchloride and the lip is of rubber or other flexible elastomeric material such as flexible polyvinylchloride. The frame and the lip are heat welded at the joining corners resulting in a seal that completely encloses and seals the glazing.

Another object of the invention is to provide large upstanding structures on roofs such as air conditioning units and industrial size skylights, that have metallic heat conductive frames, with insulating and corrosive resistant flashings that can be installed, like a collar, to completely surround and protect the portion of the flashing frame of the skylight that would be exposed. The elastomeric flashing of the invention or collar herein provided can be chemically or heat treated after fitment to the frame or vinyl covered frame to provide a complete bond between the vinyl and the frame to eliminate any weld or joint weakness in the frame of the skylight.

SUMMARY OF THE INVENTION

An elastomeric weatherseal in the form of a collarlike flashing is heat sealed or chemically glued together and to the vinyl or metallic outer surface of the downwardly depending inner leg of a skylight frame which has been fitted over a curb upstanding from a roof member of a building structure. The weatherseal is itself in the form of a frame and consists of a plurality of sealedly and lapping panels. Each panel embodies a relatively wide apron for overlying or underlying roof shingles or other like roofing covering material and sealable thereto. Each panel has an upstanding flange extending along one elongated edge thereof and the ends of the flanges have overlapping and sealedly connected wings on their respective edges. The flange aprons and wings together and collectively provide a continuous square collar surrounding the outer facing side of the inner leg of a skylight overhanging frame assembly sealing the four corners and bottom edges of the skylight assembly to the upstanding curb on the structure roof.

IN THE DRAWINGS

With the foregoing objects in view and such advantages or novel features as may become apparent from consideration of this disclosure and specification the present invention consists of the concept which is comprised embodied and embraced and included in the use, construction and arrangement of parts or any new use of the same herein exemplified in the specific embodiment of the concept reference being had to the accompanying drawings wherein like reference numerals refer to like parts.

FIG. 5 shows how the panels with the folded flanges and wings are fitted together.

FIG. 6 shows a corner of one panel fitted to the corner of an adjacent panel.

THE PREFERRED EMBODIMENT OF THE INVENTION

Figure 1:
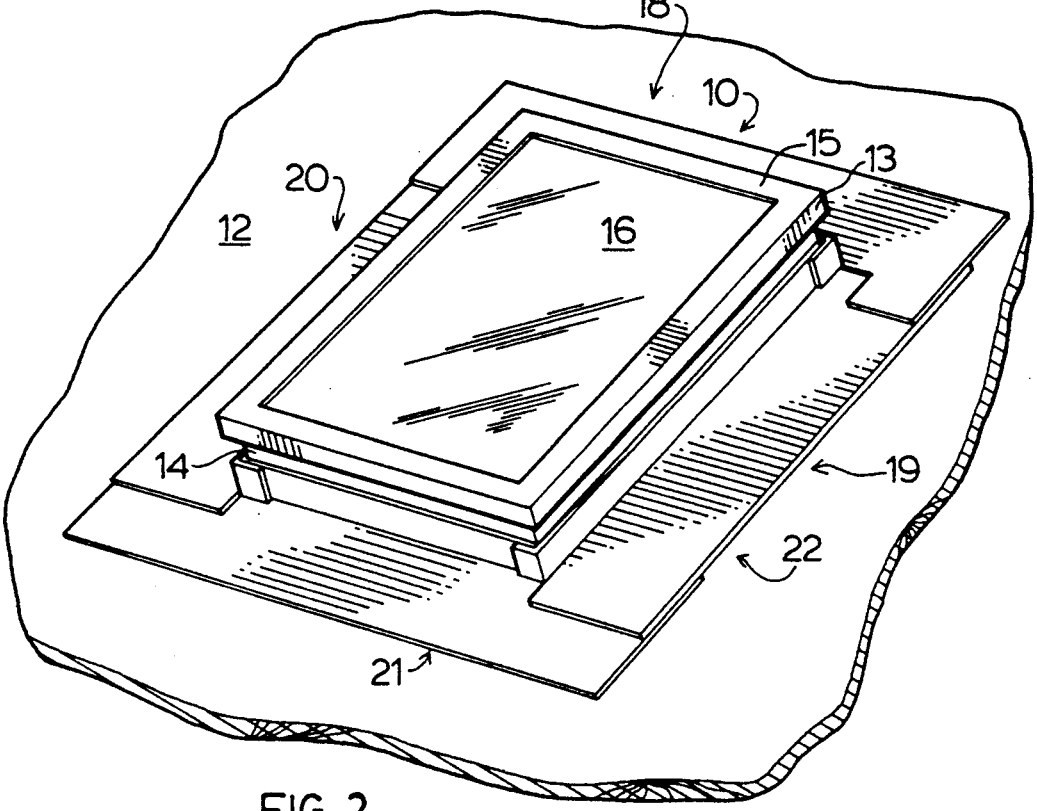
FIG. 1 is a perspective view of a skylight assembly showing the elastomeric flashing of the invention covering the roof surrounding the skylight and with a flange fitted against the outer side of the inner leg of the flashing.
Figure 2:
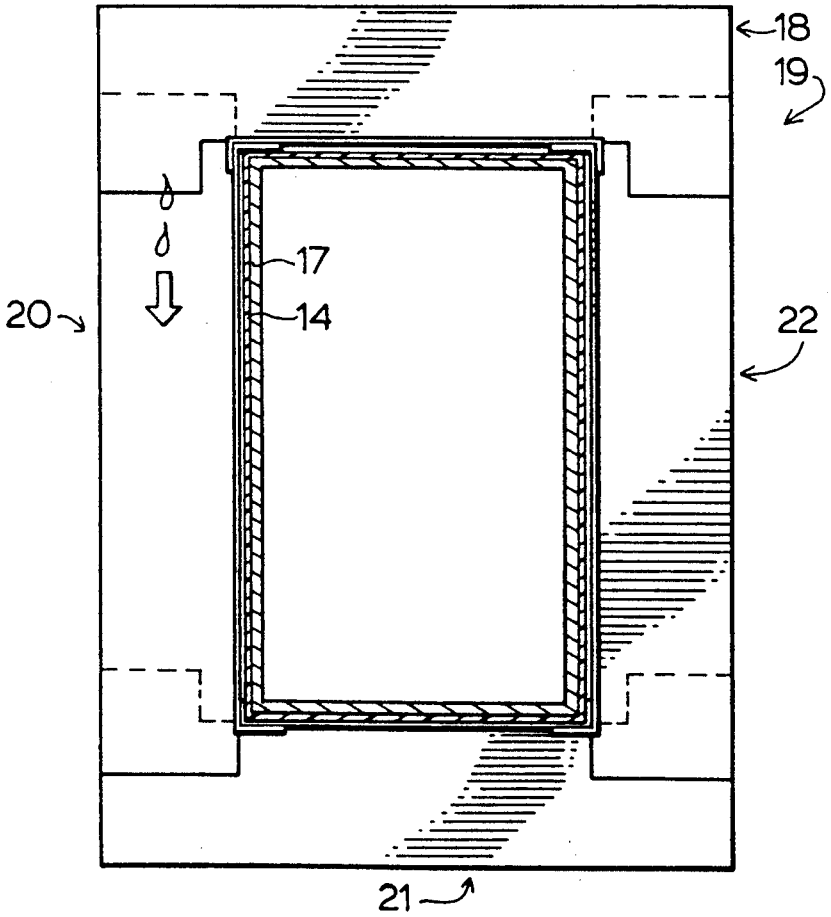
FIG. 2 is a plan view of the elastomeric flashing of the invention shown attached to the skylight assembly inner leg and showing the curb frame fitted to a roof to which the skylight is fitted in turn.
Figure 3:
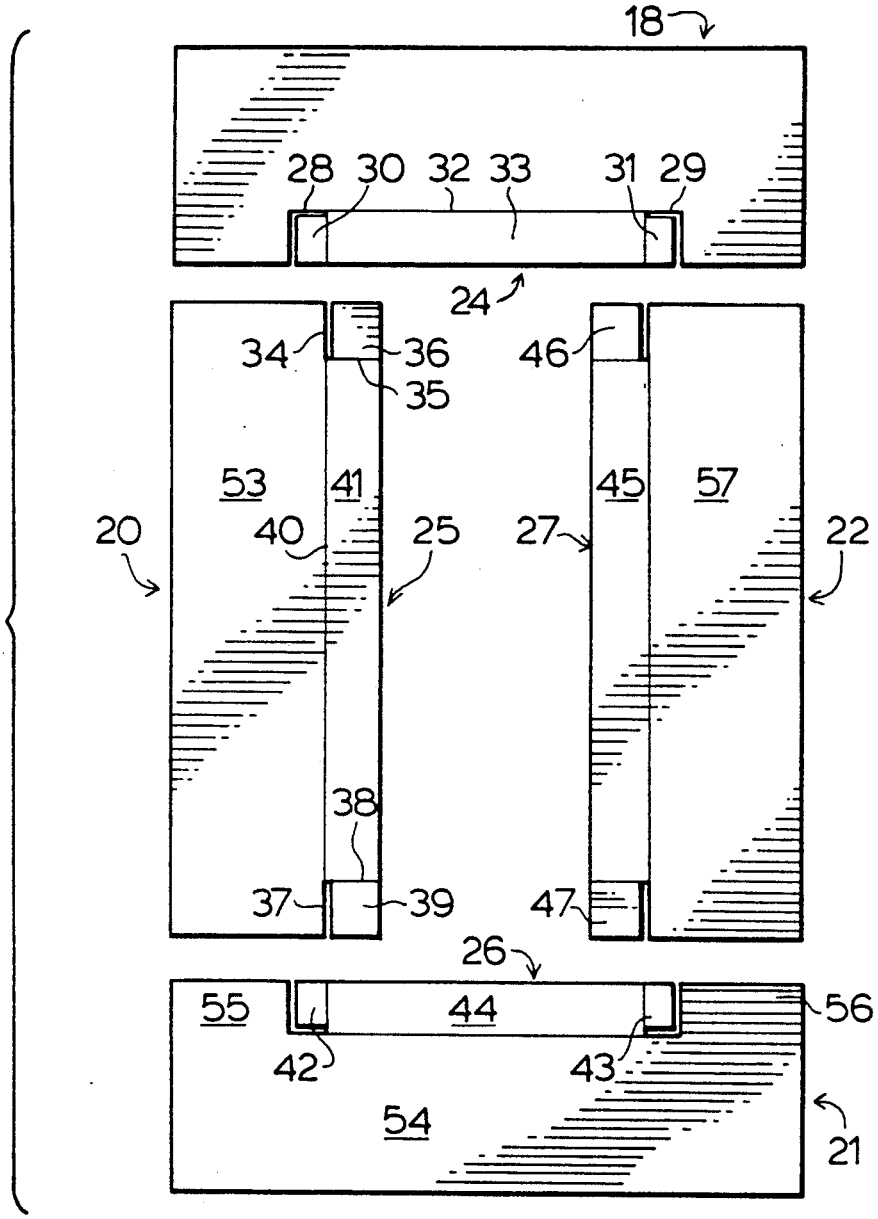
FIG. 3 shows the four separate panels of elastomer cut and folded prior to fitment to the frame and to one another.

In FIG. 1 the numeral 10 designates a skylight and is shown attached to roof 12, and it has an outer frame 13 and an inner frame 14 joined by upper web 15 into which the glazing 16 fits in the usual manner. The inner frame or leg 14 is fixed to a curb 17 usually of wood, which is attached to the roof surface 12 into which an opening has been made. The elastomeric flashing of the invention is designated as 19 and consists of four panels 18 20 21, 22. FIG. 3 shows the four panels 18 20 21, and 22 each made of a heavy sheet of rubber. Panel 18 has one edge 24 which has pairs of flaps or wings 30, 31 cut out and formed by incisions 28, 29 made t pass through the rubber panel 18. A fold line 32 is made parallel to the edge 24 thereby creating flange 33. An incision is made at 34 and at 37 in panel 20 parallel to edge 25 and fold lines are made at 35, and 38 to provide flaps 36, 39 in panel 20 with a fold line 40 to provide flange 41. Panel 21 is incised and fold lines formed as in panel 18 to provide a flange 44 and wings 42, 43 similar to panel 18. Incisions similar to those in panel 20 are made in panel 22 to provide wings 46, 47 to panel 22 and a fold line 45 is made parallel to panel inner edge 27 in panel 22. It will be understood that the panels are made of rectangular sheets of rubber and all cuts and folds are made parallel to a side or end edge of a panel.

Figure 4:
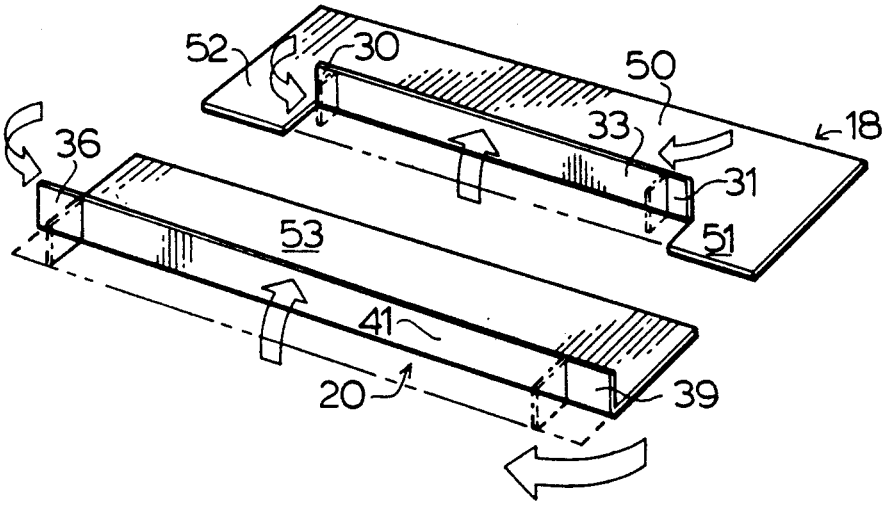
FIG. 4 shows how the panels are folded prior to installation.

In FIG. 4 the method of folding the wings 30, 31 and flange 33 are indicated by the arrows and thereby delineating a skirt member 50 with arms 51, 52. A panel 20 is shown in FIG. 4 with arrows indicating how the wings 36, and 39 are folded back with flange 41 formed by upward folding thereby creating a skirt 53. In similar manner a skirt 54 with integral side arms 55, 56 is formed in panel 21 and a skirt 57 formed in panel 22. With the panels 18, 20 21, and 22 incised and folded in accordance with the above procedure the four panels are fitted and glued together as shown by FIG. 5 with the arms 52, 21 of skirt 50 of panel 18 being fastened to the skirts of panels 20, 22 as shown by arrows and the wings 36, 46 of panels 20, 22 respectively, are mated to the inner side of panel 18 as indicated by arrows B. Similarly the lower shown panel 21 in FIG. 5 is fitted to the side panels 20, 22. It will be apparent from the drawings that all mating parts of the panels are "surface" matings and not merely line joints or matings. This system and design insures that when the mating panels are glued together the bond will be an indestructible one and when the inner surfaces of the flashing is glues to the skylight vinyl frame and to the roof no air or water will penetrate the seal.

FIG. 6 shows the "surface" mating characteristic of the flashing where skirt arm 51 and the flange 33 and wing 31 combination of panel 18 are in two thickness mating mode. The other corners are mated and bonded as the cut-away picture in FIG. 6 shows. It will be understood that a workman can cut and fit and then bond the flashing easily to a skylight and frame on the roof of a building or in the alternative a flashing of the dimensions required can be made up in a factory where the outside inner leg of the skylight is known. It is contemplated that many installations of the invention will be as replacement flashings and therefore the above method of formation of separate panels and fitting and glueing in situ will be employed.

What I claim is:

1. The method of fabricating a flashing assembly of elastomeric sheet material in the form of a frame for surrounding objects, such as skylights, projecting from roofs said assembly comprising a plurality of sealedly lapping panels each embodying a relatively wide apron and an upstanding flange extending along one elongated edge thereof the ends of said flanges having overlapping sealedly connected wings on the ends thereof whereby to provide collectively a continuous fastener surrounding the inner edges of said assembly capable of co-planar sealing engagement with a projecting curb secured around an opening hole in a roof; and wherein said flanges are integral with said panels and project substantially at right angles to the overall plane of the panels, around the inner edge of said assembly, the ends of said panels projecting in their plane to provide double-thickness overlapping, double-thickness skirting at the junction of each pair of adjacent flanges and hence extra snug packing abutments at the corners of said assembly; comprising the steps of;

making first incisions in said sheet material inwardly at right angles to the inner edge at two spaced location in the vicinity of the opposite ends thereof; making short second incisions parallel with the edge of said material and at right angles to the first incisions of a length such as to terminate at the inner ends of said first incisions; and (a) folding the sheet material such that the material between the inner ends of said first incisions at right angles to the plane of said material thereby forming said flange; and (b) folding the ends of said flanges at right angles at the junctions of said second incisions and the line-of-fold between said flange and said sheet material and also folding the incised ends of said flanges at right angles to form said wings and sealably securing adjacent wings in overlapping relationship to form a continuous collar upstanding at right angles to the plane of said sheet along the inner edge of said frame.

* * * * *